US010197943B2

(12) United States Patent
Okabe

(10) Patent No.: US 10,197,943 B2
(45) Date of Patent: Feb. 5, 2019

(54) DEVELOPER CARTRIDGE PROVIDED WITH CASING AND DEVELOPER ACCOMMODATING UNIT DETACHABLY SUPPORTED THERETO

(71) Applicant: Brother Kogyo Kabushiki Kaisha, Nagoya-shi, Aichi-ken (JP)

(72) Inventor: Yasushi Okabe, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/427,563

(22) Filed: Feb. 8, 2017

(65) Prior Publication Data

US 2017/0285527 A1 Oct. 5, 2017

(30) Foreign Application Priority Data

Mar. 31, 2016 (JP) ..... 2016-071148

(51) Int. Cl.
*G03G 15/08* (2006.01)

(52) U.S. Cl.
CPC ..... *G03G 15/0886* (2013.01); *G03G 15/0889* (2013.01)

(58) Field of Classification Search
CPC ..... G03G 15/0874; G03G 15/0884; G03G 15/0889; G03G 15/0886
See application file for complete search history.

(56) References Cited

U.S. PATENT DOCUMENTS 3,501,065 A * 3/1970 Altmann ..... G03G 15/0884 222/392
4,969,557 A * 11/1990 Oka ..... G03G 15/0882 141/364
4,998,140 A * 3/1991 Satou ..... G03G 15/0896 399/105
5,075,727 A * 12/1991 Nakatomi ..... G03G 15/0896 399/103
5,079,591 A * 1/1992 Tomita ..... G03G 15/0874 399/262
5,341,196 A * 8/1994 Hodoshima ..... G03G 15/0875 141/364
5,392,963 A * 2/1995 Kelly ..... G03G 15/0894 222/325

(Continued)

FOREIGN PATENT DOCUMENTS

JP H07-134484 A 5/1995
JP H07-160104 A 6/1995
JP 2013-037345 A 2/2013

*Primary Examiner* — David Bolduc
(74) *Attorney, Agent, or Firm* — Banner & Witcoff, Ltd.

(57) ABSTRACT

A developer cartridge includes a casing; and a sub-unit. The casing has a first opening and a developer chamber. The sub-unit is detachably attached to the developer chamber through the first opening. The sub-unit includes a cap; a developer container; and an agitation member. The cap seals the first opening. The developer container is disposed in the developer chamber and hermetically accommodating developer therein. The agitation member is disposed in the developer chamber. The agitation member has a first end portion and a second end portion. The agitation member is rotatable relative to the casing about an axis. The axis extends between the first end portion and the second end portion in an axial direction.

20 Claims, 10 Drawing Sheets

(56) References Cited

U.S. PATENT DOCUMENTS 5,500,714 A * 3/1996 Yashiro ..... G03G 21/1832 399/111
5,513,679 A * 5/1996 Yamada ..... G03G 15/0875 141/363
5,722,019 A * 2/1998 Nakajima ..... G03G 15/0872 141/364
5,802,431 A * 9/1998 Nagashima ..... G03G 15/0884 222/DIG. 1
5,887,232 A * 3/1999 Phillips ..... G03G 15/0884 222/DIG. 1
6,058,278 A * 5/2000 Tsuda ..... G03G 21/1832 399/106
6,647,236 B2 * 11/2003 Katsuyama ..... G03G 15/0874 141/364
9,213,263 B2 12/2015 Matsuzaki et al.
9,285,707 B2 * 3/2016 Matsushita ..... G03G 15/0874
2003/0223776 A1 * 12/2003 Kato ..... G03G 21/12 399/120
2012/0177406 A1 * 7/2012 Suzuki ..... G03G 15/0874 399/120
2013/0136490 A1 * 5/2013 Itabashi ..... G03G 15/0832 399/106
2013/0164039 A1 * 6/2013 Matsushita ..... G03G 21/18 399/258
2013/0164040 A1 * 6/2013 Matsushita ..... G03G 15/0874 399/258
2013/0308971 A1 * 11/2013 Kashiide ..... G03G 15/0882 399/106
2013/0308972 A1 * 11/2013 Shindo ..... G03G 15/0882 399/106
2013/0308973 A1 * 11/2013 Kashiide ..... G03G 15/0874 399/106
2013/0308979 A1 11/2013 Matsuzaki et al.
2013/0322926 A1 * 12/2013 Matsunaga ..... G03G 15/0874 399/258
2013/0336679 A1 * 12/2013 Furutani ..... G03G 15/0874 399/258
2013/0343785 A1 * 12/2013 Matsuzaki ..... G03G 15/0874 399/258
2014/0016961 A1 1/2014 Yasui et al.
2014/0027012 A1 * 1/2014 Saitoh ..... G03G 15/0867 141/10
2014/0029974 A1 * 1/2014 Uesugi ..... G03G 15/0874 399/106
2014/0064793 A1 * 3/2014 Matsuzaki ..... G03G 15/0841 399/258
2014/0072329 A1 * 3/2014 Uesugi ..... G03G 15/0874 399/106
2014/0072330 A1 * 3/2014 Yoshida ..... G03G 15/0884 399/106
2014/0072331 A1 * 3/2014 Matsushita ..... G03G 15/0884 399/106
2014/0072345 A1 * 3/2014 Matsunaga ..... G03G 15/0874 399/258
2014/0072346 A1 * 3/2014 Furutani ..... G03G 15/0865 399/262
2014/0072347 A1 * 3/2014 Furutani ..... G03G 15/0874 399/262
2014/0079432 A1 * 3/2014 Matsuzaki ..... G03G 15/0874 399/106
2014/0199092 A1 * 7/2014 Matsushita ..... G03G 15/0841 399/106
2014/0199093 A1 * 7/2014 Yoshida ..... G03G 15/0882 399/106
2014/0199096 A1 * 7/2014 Yoshida ..... G03G 21/1676 399/258
2014/0212181 A1 * 7/2014 Nakamura ..... G03G 15/0874 399/258
2014/0363196 A1 * 12/2014 Wada ..... G03G 15/0898 399/106
2014/0376955 A1 * 12/2014 Takeuchi ..... G03G 15/0881 399/106
2014/0376969 A1 * 12/2014 Batori ..... G03G 15/0874 399/258
2015/0003865 A1 * 1/2015 Batori ..... G03G 15/0882 399/106
2015/0117904 A1 * 4/2015 Mori ..... G03G 15/0891 399/254
2015/0139684 A1 * 5/2015 Nakazawa ..... G03G 15/0874 399/106
2015/0205226 A1 * 7/2015 Komatsu ..... G03G 15/0874 399/258
2015/0234319 A1 * 8/2015 Matsumura ..... B65B 51/10 399/111
2016/0124347 A1 * 5/2016 Isobe ..... G03G 15/0894 399/109

* cited by examiner

DEVELOPER CARTRIDGE PROVIDED WITH CASING AND DEVELOPER ACCOMMODATING UNIT DETACHABLY SUPPORTED THERETO

CROSS REFERENCE TO RELATED APPLICATION

This application claims priority from Japanese Patent Application No. 2016-071148 filed Mar. 31, 2016. The entire content of the priority application is incorporated herein by reference.

TECHNICAL FIELD

The present disclosure relates to a developer cartridge and a developer accommodating unit.

BACKGROUND

There is conventionally known a developer cartridge for an electrophotographic-type image forming apparatus that forms a developer image on a recording medium. Japanese patent application publication No. 2013-37345 discloses one such developer cartridge provided with a developer bag (i.e. flexible developer container). The developer bag accommodates toner (i.e. developer) therein and is disposed inside a casing of the developer cartridge. An opening of the developer container is sealed with a sealing member when the developer cartridge is shipped. When the developer cartridge is used for the first time, the sealing member is peeled off by an opening member, and the opening is irreversibly open. The opening member also functions as an agitation member for agitating developer.

SUMMARY

However, in the above conventional developer cartridge, the developer container is fixed to the casing. This configuration may be inconvenient for replacing the developer container and refilling the developer container with toner.

In view of the foregoing, it is an object of the disclosure to provide a developer cartridge capable of easily replacing a developer container and refilling the developer container with developer.

In order to attain the above and other objects, the disclosure provides a developer cartridge including: a casing; and a sub-unit. The casing has a first opening and a developer chamber. The sub-unit is detachably attached to the developer chamber through the first opening. The sub-unit includes: a cap; a developer container; and an agitation member. The cap seals the first opening. The developer container is disposed in the developer chamber and hermetically accommodating developer therein. The agitation member is disposed in the developer chamber. The agitation member has a first end portion and a second end portion. The agitation member is rotatable relative to the casing about an axis. The axis extends between the first end portion and the second end portion in an axial direction.

According to another aspect, the disclosure provides a developer accommodating unit used for a developing cartridge including a casing. The casing supports a developing roller and detachably supports the developer accommodating unit. The developer accommodating unit includes: a developer container; an agitation member; and a cap. The developer container hermetically accommodates developer therein. The agitation member is configured to agitate the developer within the casing. The cap seals an opening formed in the casing in a state where the developer container and the agitation member are disposed inside the casing and a state where the agitation member is rotatably supported to the casing.

Note that "a state where the developer has been discharged from the developer container into the developer chamber" implies a state where the developer has been completely discharged out from the developer container or a state where a threshold amount of the developer remains in the developer container as a result of discharge of the developer. Further, "a state where the developer is accommodated in the developer container" implies a state where the developer is accommodated in the developer container at its full capacity or a state where the amount of the developer accommodated in the developer container is more than the threshold amount.

BRIEF DESCRIPTION OF THE DRAWINGS

The particular features and advantages of the embodiment(s) as well as other objects will become apparent from the following description taken in connection with the accompanying drawings, in which.

DETAILED DESCRIPTION

<First Embodiment>

Figure 1:
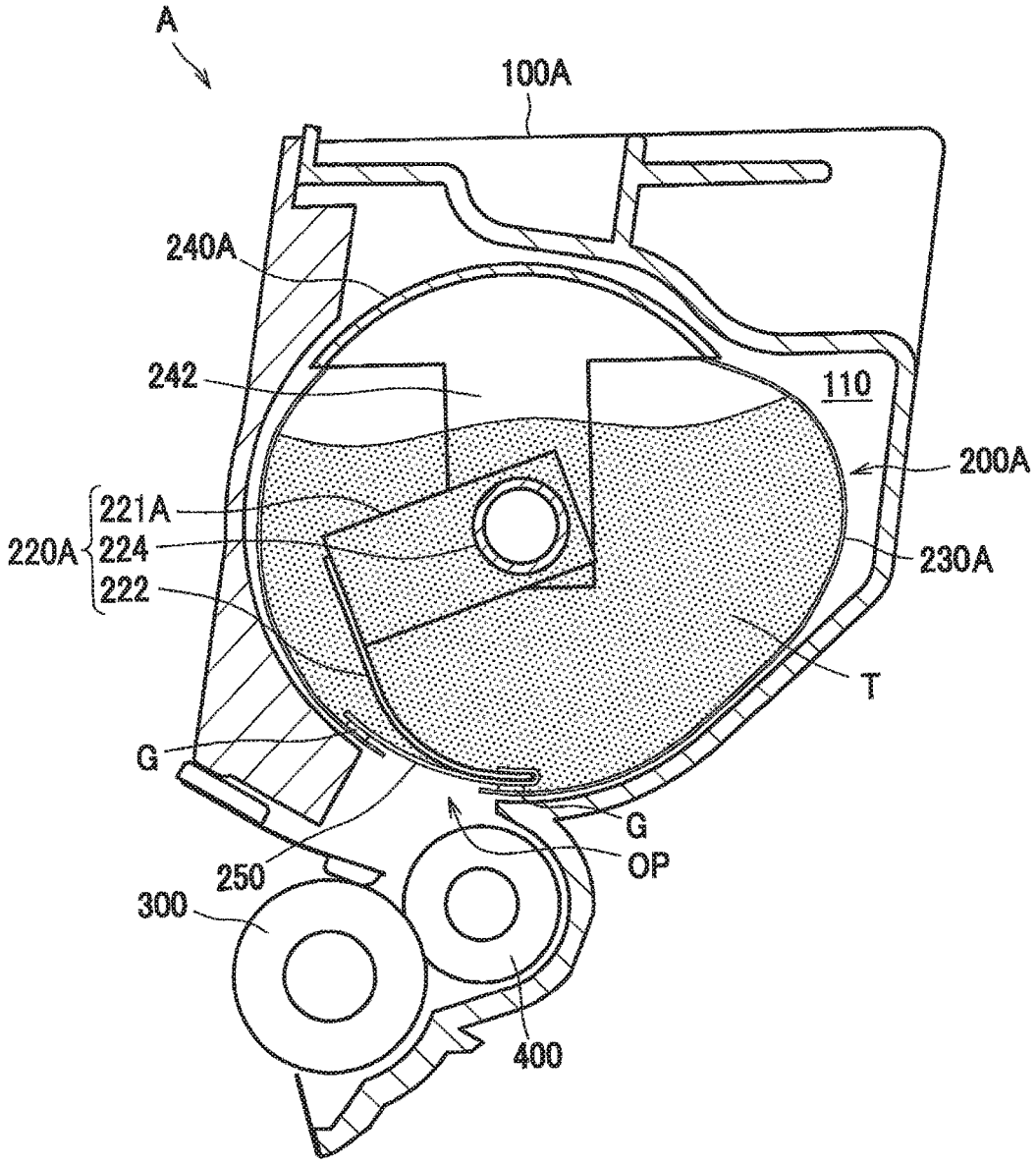
FIG. 1 is a cross-sectional view of a developing cartridge according to a first embodiment.

A developing cartridge A as an example of a developer cartridge according to a first embodiment will be described with reference to FIGS. 1 through 4B, wherein like parts and components are designated by the same reference numerals to avoid duplicating description. The developing cartridge A can be detachably attached to an electrophotographic-type image forming apparatus, such as a laser printer and a copier, for supplying toner as an example of a developer to a photosensitive member provided in the image forming apparatus.

As illustrated in FIG. 1, the developing cartridge A includes a casing 100A, a developer accommodating unit 200A as an example of a sub-unit, a developing roller 300, and a supply roller 400. The casing 100A has a developer chamber 110 and an opening 120A (first opening). The developer accommodating unit 200A is detachably supported to the casing 100A. More specifically, the developer accommodating unit 200A is detachably attached to the developer chamber 110 through the opening 120A. The developing roller 300 and the supply roller 400 are rotatably supported to the casing 100A.

Figure 2:
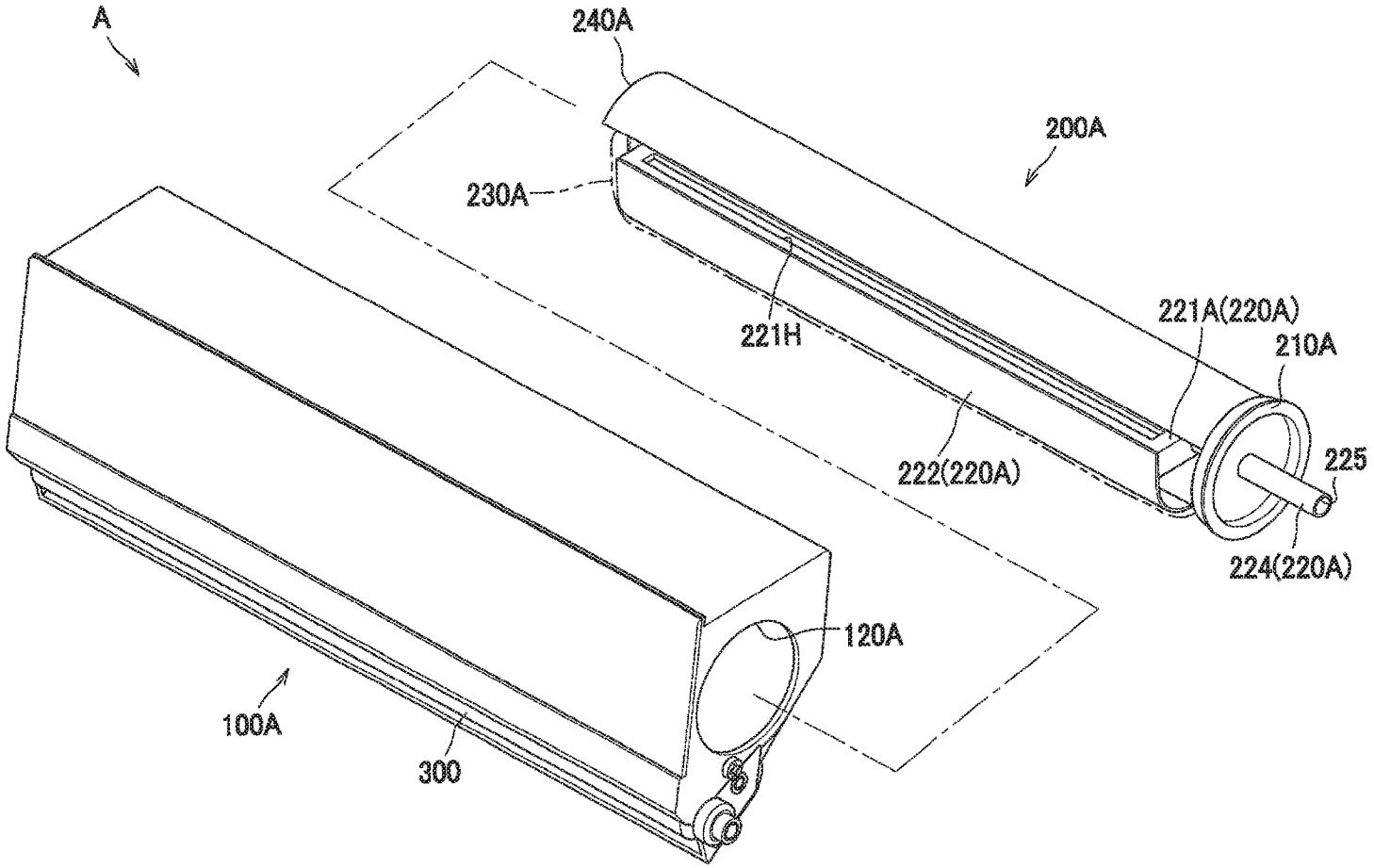
FIG. 2 is an exploded perspective view of the developing cartridge according to the first embodiment, in which a developer accommodating unit has not yet been mounted to a casing.
Figure 3:
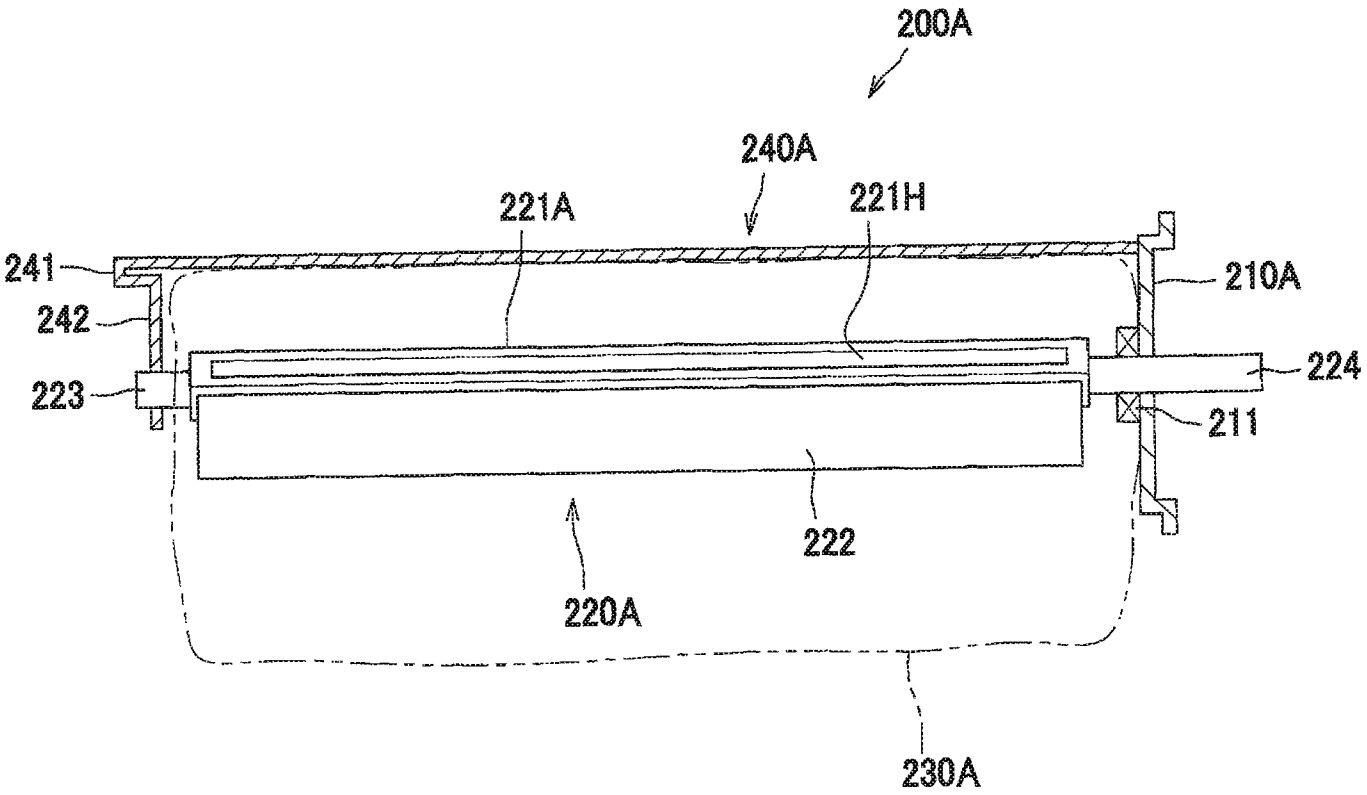
FIG. 3 is a cross-sectional view of the developer accommodating unit of the developing cartridge according to the first embodiment.

As illustrated in FIGS. 2 and 3, the developer accommodating unit 200A includes a cap 210A, an agitator 220A as an example of an agitation member, a developer bag 230A as an example of a developer container, and a rigid frame 240A. The rigid frame 240A supports the agitator 220A and the developer bag 230A. The developer accommodating unit 200A is detachably supported to the casing 100A.

The rigid frame 240A and the cap 210A have rigidity equivalent to rigidity of the casing 100A. The developer bag 230A is more deformable (in terms of flexibility, resiliency, and elasticity) than the rigid frame 240A and the cap 210A. Hence, when toner T is not accommodated in the developer bag 230A, the volume of the developer bag 230A can be reduced by compressing the developer bag 230A. That is, the developer bag 230A is deformable.

The developer bag 230A can be formed of any materials. For example, the developer bag 230A may be formed of a material, such as polyethylene terephthalate (PET), polyethylene (PE), or polypropylene (PP). An elastic material such as a rubber may also be used for forming a part of the developer bag 230A or the developer bag 230A in its entirety. Alternatively, the developer bag 230A may be formed of a flexible material, a part of which has a rigid portion. Still alternatively, the developer bag 230A may be formed of a flexible material in which a resilient member such as a spring is embedded.

The rigid frame 240A and the cap 210A are fixed to each other to form a single unit. The developer bag 230A is bonded to an inner surface of the rigid frame 240A and an inner surface of the cap 210A.

The agitator 220A is adapted to agitate toner T accommodated in the developer chamber 110 formed in the casing 100A. The agitator 220A includes an agitator shaft 221A, and an agitation sheet 222. The agitation sheet 222 has one end portion fixed to the agitator shaft 221A. The agitation sheet 222 is rotatable together with the agitator shaft 221A.

The agitator shaft 221A has one end portion 223 (i.e. first end portion) and the other end portion 224 (i.e. second end portion). The first end portion 223 is supported by a bearing plate 242 of the rigid frame 240A. The second end portion 224 is supported by a bearing 211 of the cap 210A and extends through the cap 210A. Incidentally, the bearing 211 has a sealing function. A gear (not illustrated) is mounted to the second end portion 224. When a drive force is inputted into the developing cartridge A, the agitator 220A receives the drive force through the gear and is driven to rotate.

In the present embodiment, the agitator 220A is provided such that the agitation sheet 222 and the portion of the agitator shaft 221A to which the agitation sheet 222 is fixed are disposed inside the developer bag 230A.

The agitator shaft 221A has a hollow configuration. The portion of the agitator shaft 221A disposed inside the developer bag 230A is formed with a hole 221H. The second end portion 224 disposed outside the casing 100A has a toner inlet port 225 for filling the interior of the developer bag 230A with toner T. The toner inlet port 225 is positioned outside the cap 210A in an axial direction of the agitator shaft 221A. The toner inlet port 225 can be closed by being tightly-sealed with a cap or by compressing and welding after the developer bag 230A is filled with toner T. Note that the developer accommodating unit 200A illustrated in FIGS. 2 and 3 shows a state before the developer bag 230A is filled with toner T.

In order to attach the developer accommodating unit 200A to the developer chamber 110 of the casing 100A, the agitator 220A, the developer bag 230A, and the rigid frame 240A are inserted into the developer chamber 110 through the opening 120A. Then, a protruding portion 241 (FIG. 3) constituting one end portion (i.e. leading end portion in the inserting direction) of the rigid frame 240A is fitted into a recessed portion (not illustrated) of the casing 100A, and supported to the casing 100A. Further, the cap 210A is press-fitted into the opening 120A of the casing 100A for sealing the opening 120A.

Figure 4A:
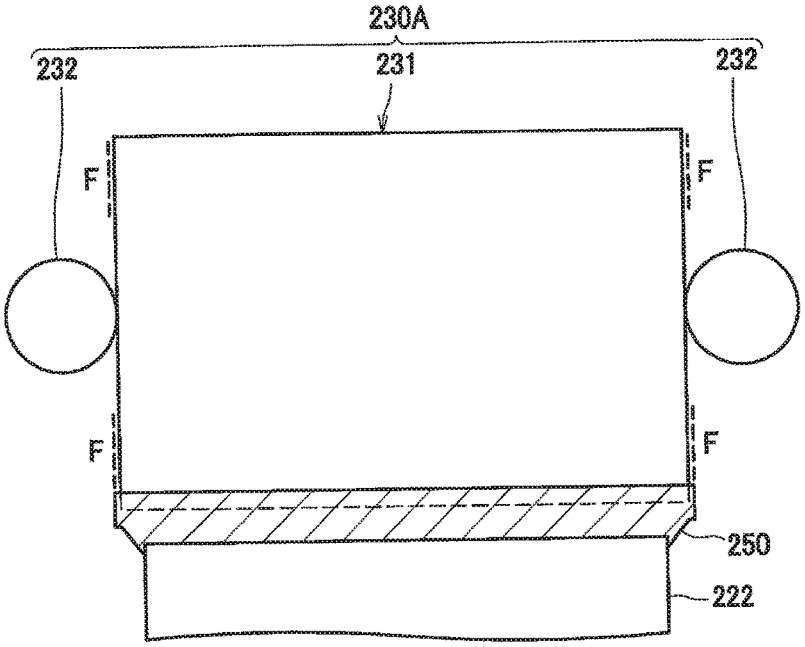
FIG. 4A is a developed view for explaining the shape of a developer bag of the developing cartridge according to the first embodiment.

Next, a configuration of the developer bag 230A and an opening mechanism for opening the developer bag 230A will be described while referring to FIGS. 1, 4A, and 4B.

As illustrated in FIG. 1, the developer bag 230A has a discharge opening OP. The discharge opening OP is sealed by a peel seal 250 as an example of a sealing member from an inner side of the developer bag 230A. An adhesive agent G is disposed along the entire circumference of the discharge opening OP so as to surround the discharge opening OP. The peel seal 250 is bonded to the developer bag 230A by the adhesive agent G to hermetically-seal the discharge opening OP of the developer bag 230A.

The peel seal 250 has an upstream end portion in a rotating direction of the agitator 220A (clockwise direction in FIG. 1). The upstream end portion of the peel seal 250 is folded inwardly to be fixed to an inner surface of a free end portion of the agitation sheet 222.

The developer bag 230A has a cylindrical portion 231 and circular-shaped side portions 232, 232. The discharge opening OP illustrated in FIG. 1 is formed by a gap between one end of the cylindrical portion 231 and the other end of the cylindrical portion 231 when the cylindrical portion 231 is formed into a cylindrical shape. The discharge opening OP is closed by the peel seal 250. Joining regions at which the cylindrical portion 231 and the side portions 232, 232 are joined to each other have portions indicated by a reference sign "F". The portions F have strength lower than that of the remaining portions in the developer bag 230A, and are tearable or openable with a pressure applied thereto when opening the developer bag 230A more easily than the remaining portions. Hereinafter, the portions F will be referred to as "tearable portions F". One end of the peel seal 250 is bonded to the agitation sheet 222 of the agitator 220A.

Figure 4B:
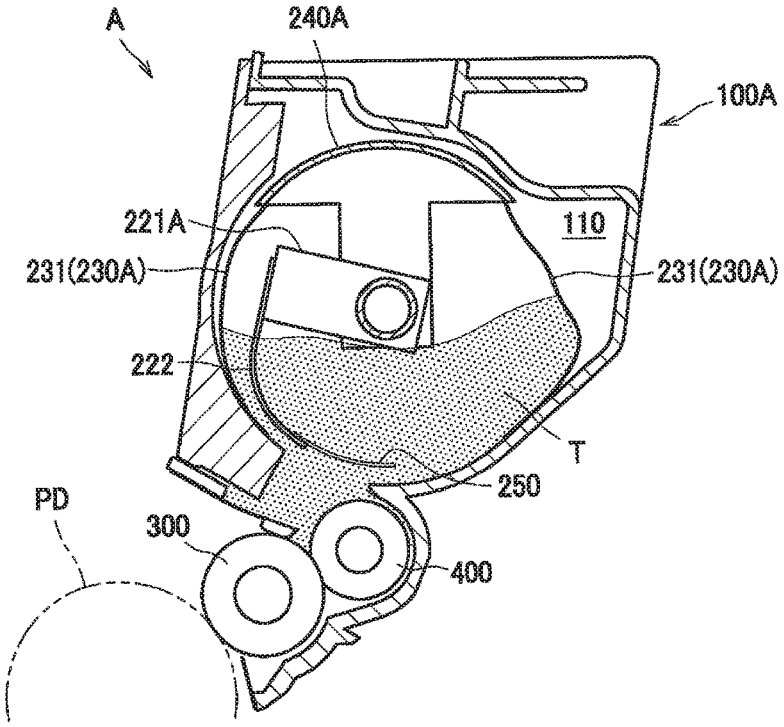
FIG. 4B is a cross-sectional view of the developing cartridge according to the first embodiment, in which the developer bag has been opened.

FIG. 4B illustrates a state of the developer bag 230A after the developer bag 230A is opened. When an image forming operation is started and the agitator 220A starts rotating in a state where the developing cartridge A is mounted to the image forming apparatus, the peel seal 250 that seals the discharge opening OP is peeled off from the developer bag 230A. At this time, the tearable portions F of the developer bag 230A are torn to expand the discharge opening OP, thereby discharging the toner T accommodated in the developer bag 230A into the developer chamber 110.

Then, the agitation sheet 222 of the rotating agitator 220A agitates the toner T accommodated in the developer chamber 110 to supply the toner T to the developing roller 300 through the supply roller 400. The peel seal 250 that has peeled off from the developer bag 230A and now extends from the free end portion of the agitation sheet 222 in the rotating direction of the agitator 220A can act to assist the agitation sheet 222 in agitating the toner T.

The developing roller 300 of the developing cartridge A mounted to the image forming apparatus is disposed in confrontation with a photosensitive drum PD. The rotating supply roller 400 supplies the toner T to the developing roller 300, and the toner T carried on the developing roller 300 is then supplied to the photosensitive drum PD on which an electrostatic latent image is formed. As a result, a developer image is formed on the surface of the photosensitive drum PD.

The developing cartridge A according to the first embodiment can obtain the following operational advantages:

In the developing cartridge A, the cap 210A, the agitator 220A, the developer bag 230A, and the rigid frame 240A are assembled to constitute a sub-unit (developer accommodating unit 200A). The sub-unit is detachably supported to the casing 100A. That is, the sub-unit is detachably attached to the developer chamber 110 of the casing 100A through the opening 120A. Hence, refilling of the toner T that requires exchange of the developer bag 230A can be easily performed.

Further, the toner T can be stored in the casing 100A while hermetically sealed therein. Therefore, this configuration is advantageous for storing the toner T for a long period of time after production and shipment of the developing cartridge A. Thus, outer packaging of the developing cartridge A can be simplified, thereby reducing production cost of the developing cartridge A.

The developer bag 230A is a flexible bag that can be folded or deformed. Hence, the developer bag 230A can be made more compact when the toner T is not accommodated in the developer bag 230A. Further, the developer bag 230A can be filled with the toner T through the toner inlet port 225 formed at the second end portion 224 of the agitator shaft 221A. The second end portion 224 is an end portion of the agitator shaft 221A at which the gear through which the drive force is inputted into the developing cartridge A is disposed. Hence, the developer bag 230A can be filled with the toner T after the compacted developer bag 230A is attached to the casing 100A through the opening 120A.

Further, as illustrated in FIG. 1, the toner T can be supplied to the developer bag 230A while the developer bag 230A is deformed in conformance with a shape of an inner wall of the developer chamber 110. Hence, a space in the developer chamber 110 of the casing 100A can be utilized as much as possible for accommodating a greater amount of the toner T. Further, the developer bag 230A is also available for a small-capacity developing cartridge if the amount of the toner T accommodated in the developer bag 230A is reduced. Accordingly, production cost can be reduced when the developer bag 230A is mass-produced as a standardized component.

The developer accommodating unit 200A is provided with the rigid frame 240A. The rigid frame 240A is fixed to the cap 210A, and supports the first end portion 223 and the second end portion 224 of the agitator shaft 221A. Further, the developer bag 230A is bonded to the rigid frame 240A. In comparison with a case where one such rigid frame is not provided for connecting respective bearing portions supporting the first and second end portions 223, 224 of the agitator shaft 221A, the developer accommodating unit 200A can be easily handled when the developer accommodating unit 200A is detached from and attached to the casing 100A. Further, the agitator 220A can be securely supported by the rigid frame 240A. Thus, stable driving of the agitator 220A can be realized.

Further, the bearing portions supporting the first and second end portions 223, 224 of the agitator shaft 221A are not provided at the casing 100A, but are provided at the cap 210A and the rigid frame 240A of the developer accommodating unit 200A which is replaceable. The bearing portions are subjected to frictional wearing and thus degrade quickly. Since the bearing portions are provided at the replaceable developer accommodating unit 200A, maintenance and replacement operations of the bearing portions can be easily performed. Thus, service life of the developing cartridge A can be prolonged.

The portion of the agitator 220A except for the first end portion 223 and the second end portion 224 is disposed inside the developer bag 230A. In comparison with a case where the portion of the agitator 220A except for the first end portion 223 and the second end portion 224 is disposed outside the developer bag 230A, the developer accommodating unit 200A can be made more compact. Accordingly, the opening 120A of the casing 100A can be made smaller. As a result, sealing of the opening 120A with the cap 210A can be reliably and easily achieved.

The developer bag 230A can be opened in conjunction with driving (rotation) of the agitator 220A. Hence, when the agitator 220A performs an initial operation after the developing cartridge A is mounted to the image forming apparatus, the developer bag 230A can be automatically opened by using the driving force for rotating the agitator 220A. Thus, no additional driving force is necessary for opening the developer bag 230A. Accordingly, automated opening of the developer bag 230A can be achieved through a simple configuration.

The developer bag 230A has the discharge opening OP for discharging the toner T, and the peel seal 250 as a sealing member covers the discharge opening OP so as to be capable of opening the same. Thus, the layout, shape, and size of the discharge opening OP can be appropriately designed. In particular, the tearable portions F are provided at part of the developer bag 230A, thereby optimizing discharging of the toner T.

Next, a developing cartridge B according to a second embodiment, a developing cartridge C according to a third embodiment, and a developing cartridge D according to a fourth embodiment will be described while referring to FIGS. 5 through 10, wherein like parts and components are designated with the same reference numerals as those of the first embodiment to avoid duplicating description. The configuration of the developer accommodating unit 200A according to the first embodiment is partially changed to provide developing accommodating units 200B, 200C, 200D according to the second, third, fourth embodiments. Therefore, in the following description, only parts differing from those of the first embodiment will be described in detail.

<Second Embodiment>

The developing cartridge B according to the second embodiment will be described in detail while referring to FIGS. 5 through 7.

Figure 5:
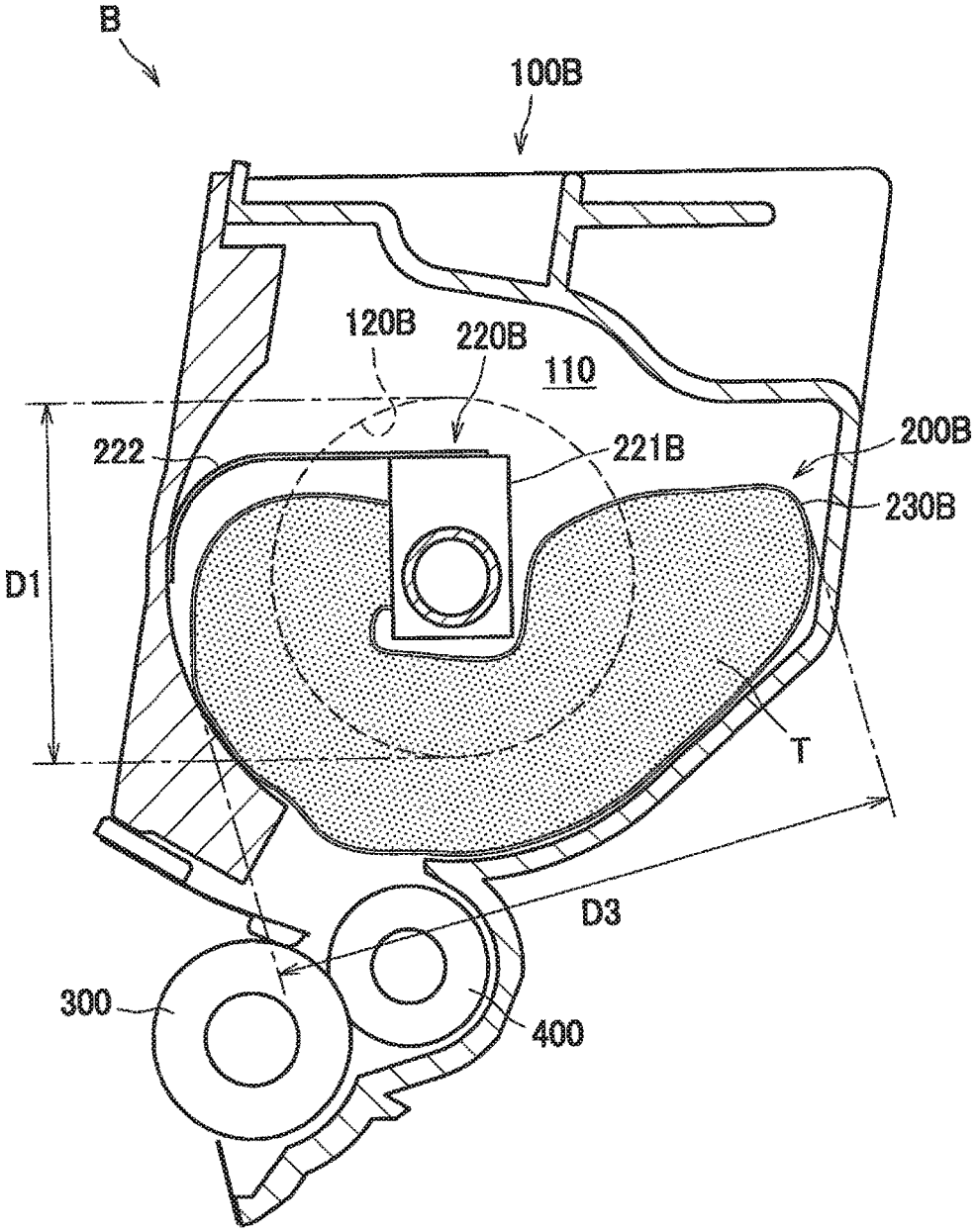
FIG. 5 is a cross-sectional view of a developing cartridge according to a second embodiment.
Figure 6:
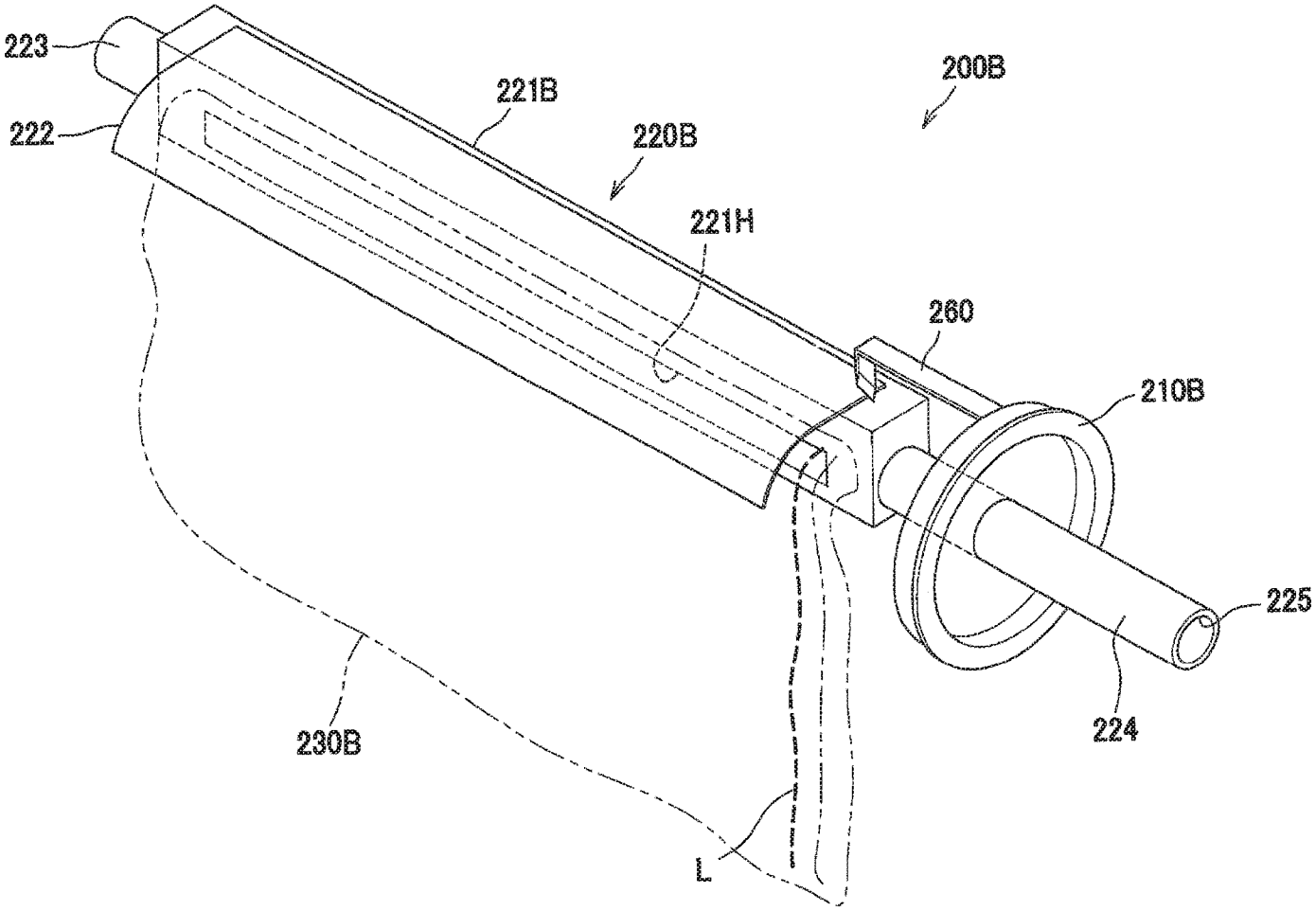
FIG. 6 is a cross-sectional view of a developer accommodating unit of the developing cartridge according to the second embodiment.
Figure 7:
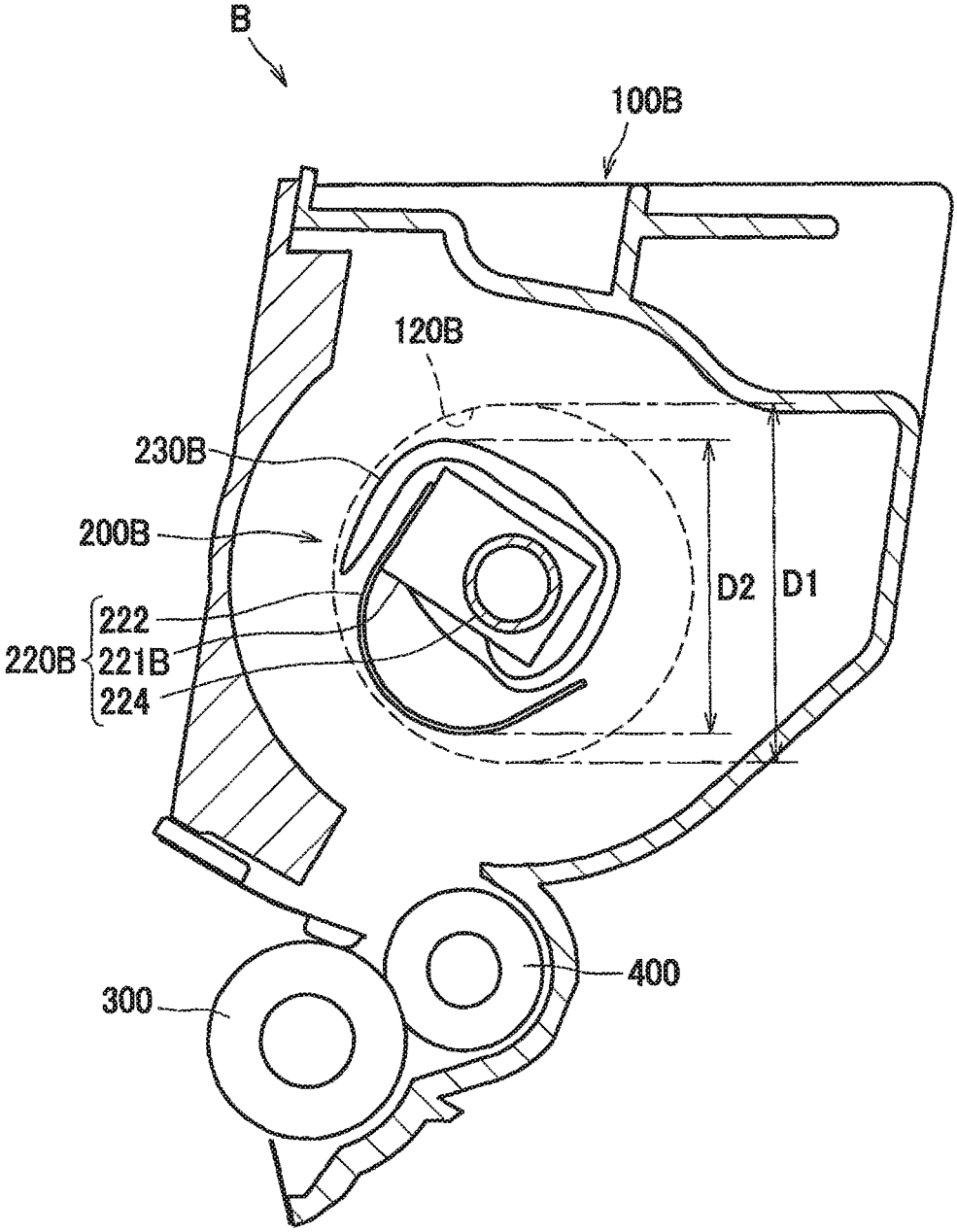
FIG. 7 is a cross-sectional view of the developing cartridge according to the second embodiment, in which toner has not yet been accommodated in the developer accommodating unit.

As illustrated in FIGS. 5 and 6, the developing cartridge B includes a casing 100B, and the developer accommodating unit 200B detachably supported to the casing 100B. Specifically, the developer accommodating unit 200B is detachably attached to the developer chamber 110 of the casing 100B through an opening 120B. An agitator 220B of the developer accommodating unit 200B is disposed outside of a developer bag 230B. No rigid frame is provided. The developer bag 230B is attached to a side surface of an agitator shaft 221B of the agitator 220B.

Similarly to the agitator shaft 221A according to the first embodiment, the agitator shaft 221B has a hollow configuration. In the second embodiment, the hole 221H is formed in a portion of the agitator shaft 221B to which the developer bag 230B is fixed. The toner inlet port 225 is formed in the second end portion 224 of the agitator shaft 221B disposed outside the casing 100B. The toner inlet port 225 can be closed. Through the toner inlet port 225, the developer bag 230B can be filled with the toner T.

Similarly to the agitator shaft 221A according to the first embodiment, the second end portion 224 of the agitator shaft 221B is supported by the bearing 211 (FIG. 3) of a cap 210B and extends through the cap 210B. The bearing 211 of the cap 210B also has a sealing function. The first end portion 223 of the agitator shaft 221B is supported by a bearing portion (not illustrated) provided in the casing 100B.

A cutter 260 illustrated in FIG. 6 is provided at the developer accommodating unit 200B. The cutter 260 functions as the opening mechanism for opening the developer bag 230B. The cutter 260 is fixed to the cap 210B. The cutter 260 is adapted to cut the developer bag 230B along a dashed line L indicated in FIG. 6 when the agitator 220B is rotated in a state where the developer bag 230B accommodates the toner T therein as illustrated in FIG. 5. The cutter 260 is an example of a protrusion.

Note that a portion of the developer bag 230B along the dashed line L that is cut by the cutter 260 may have a configuration similar to the tearable portions F provided for facilitating opening of the developer bag 230A in the first embodiment. That is, the cut portion of the developer bag 230B has strength lower than that of the remaining portions in the developer bag 230B and is more easily tearable or openable than the remaining portions. In this case, in place of the cutter 260, a needle-like protrusion may be provided for piercing the tearable portion F of the developer bag 230B to open the developer bag 230B.

According to the second embodiment, the following operational advantages can be obtained:

In the developing cartridge B, the cap 210B, the agitator 220B, and the developer bag 230B are assembled to constitute a sub-unit (developer accommodating unit 200B). The sub-unit is detachably supported to the casing 100B. That is, the sub-unit is detachably attached to the developer chamber 110 of the casing 100B through the opening 120B. Hence, refilling of the toner T that requires exchange of the developer bag 230B can be easily performed.

Similarly to the first embodiment, the toner T can be stored in the casing 100B while hermetically sealed therein. Therefore, this configuration is advantageous for storing the toner T for a long period of time after production and shipment of the developing cartridge B. Thus, outer packaging of the developing cartridge B can be simplified, thereby reducing production cost of the developing cartridge B.

In particular, according to the second embodiment, the agitator 220B is disposed outside the developer bag 230B. Further, no rigid frame is provided. Thus, as illustrated in FIG. 7, the developer bag 230B formed of a flexible bag can be wound around the agitator shaft 221B together with the agitation sheet 222 when the toner T is not accommodated in the developer bag 230B. Accordingly, the developer bag 230B can be made far more compact.

Here, the size of the developer accommodating unit 200B (i.e. maximum dimension of the developer accommodating unit 200B in a plane perpendicular to an axial direction of the agitator 220B) is compared with a diameter D1 (FIGS. 5 and 7) of the opening 120B of the casing 100B. The developer accommodating unit 200B has a size D2 (FIG. 7) when the developer bag 230B is wound around the agitator shaft 221B together with the agitation sheet 222 in a state where the developer bag 230B has not yet filled with the toner T or the toner T has been discharged from the developer bag 230B. Further, the developer accommodating unit 200B has a size D3 (FIG. 5) in a state where the toner T is accommodated in the developer bag 230B. The size D2 of the developer accommodating unit 200B is slightly smaller than the diameter D1 (see FIG. 7). On the other hand, the size D3 of the developer accommodating unit 200B is greater than the diameter D1 (see FIG. 5).

Note that "a state where the toner T has been discharged from the developer bag 230B" implies a state where the toner T has been completely discharged out from the developer bag 230B or a state where a threshold amount of the toner T remains in the developer bag 230B as a result of discharge of the toner T. Further, "a state where the toner T is accommodated in the developer bag 230B" implies a state where the toner T is accommodated in the developer bag 230B at its full capacity or a state where the amount of the toner T accommodated in the developer bag 230B is more than the threshold amount.

Accordingly, the opening 120B is designed to have a shape and a dimension such that the opening 120B permits the developer bag 230B and the agitator 220B to pass therethrough in a state where the toner T has not yet been accommodated in the developer bag 230B (i.e. a state where the developer bag 230B is empty) or a state where the toner T has been discharged from the developer bag 230B into the developer chamber 110 and such that the opening 120B prohibits the developer bag 230B and the agitator 220B to pass therethrough in a state where the toner T is accommodated in the developer bag 230B.

It is also noted that, similarly to the first embodiment, the developer bag 230B can be filled with the toner T through the second end portion 224 that is an end portion of the agitator shaft 221B at which a gear through which a drive force is inputted into the developing cartridge B is disposed. Hence, the developer accommodating unit 200B with the compacted developer bag 230B can be attached to the casing 100B through the opening 120B. Accordingly, the opening 120B of the casing 100B can be made smaller, thereby reliably and easily achieving hermetically-seal of the casing 100B with the cap 210B.

Further, similarly to the first embodiment, the developer bag 230B can be opened in conjunction with driving of the agitator 220B. Hence, when the agitator 220B performs an initial operation after the developing cartridge B is mounted to the image forming apparatus, the developer bag 230B can be automatically opened by using the driving force for rotating the agitator 220B. Thus, no additional driving force is necessary for opening the developer bag 230B. Accordingly, automated opening of the developer bag 230B can be achieved through a simple configuration.

Further, the opening mechanism according to the second embodiment is realized by the configuration without a peel seal. Thus, the developer bag 230B has a simple configuration without an opening. Further, no sealing member is required for the developer bag 230B. Accordingly, production cost for the developing cartridge B can be restrained.

<Third Embodiment>

Next, the developing cartridge C according to the third embodiment will be described in detail while referring to FIGS. 8 through 9B.

Figure 8:
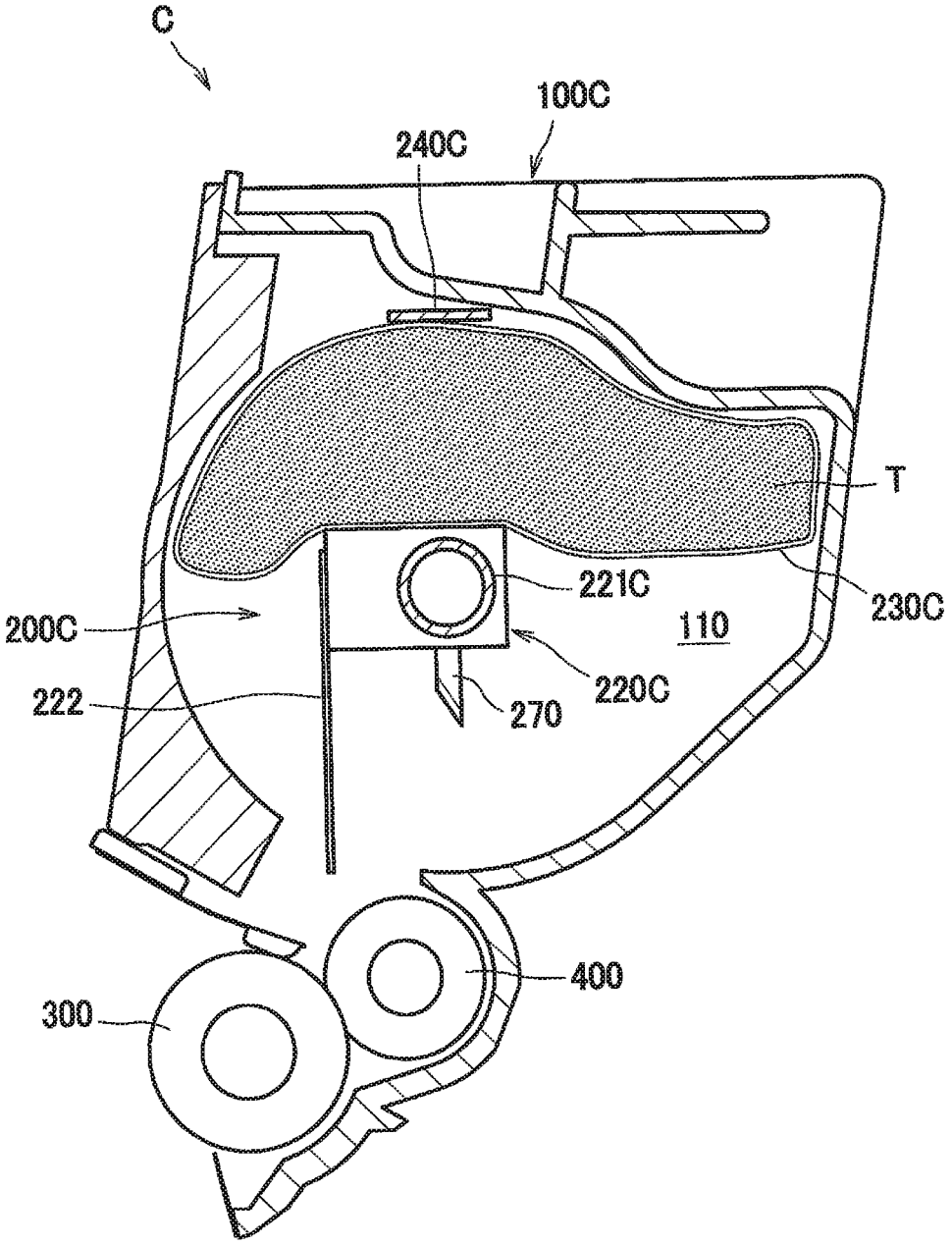
FIG. 8 is a cross-sectional view of a developing cartridge according to a third embodiment.
Figure 9A:
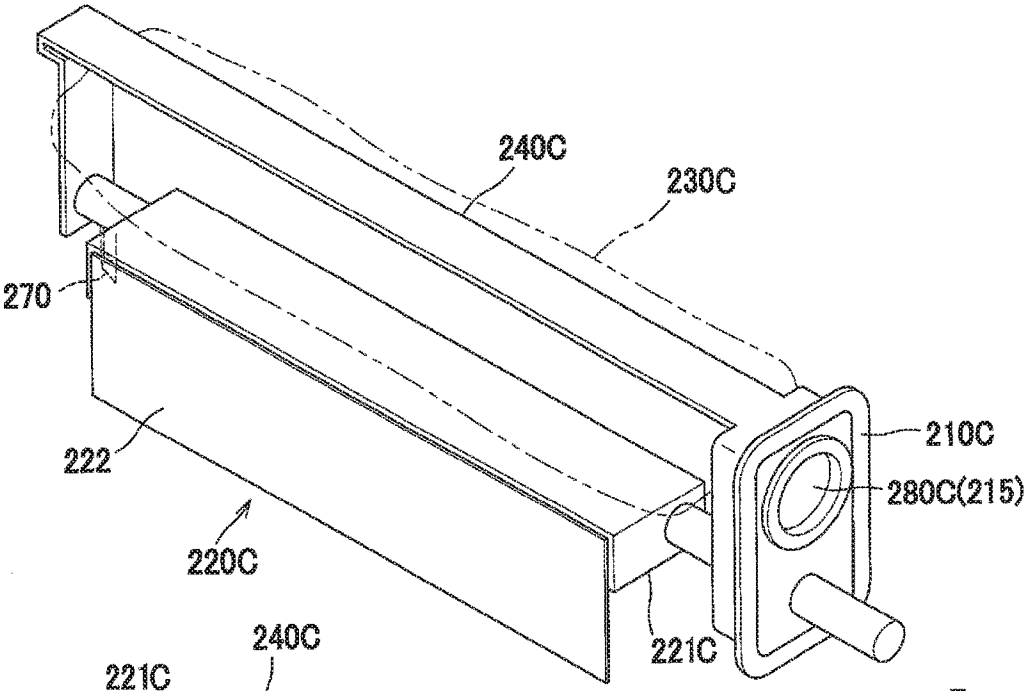
FIG. 9A is a perspective view of a developer accommodating unit of the developing cartridge according to the third embodiment.
Figure 9B:
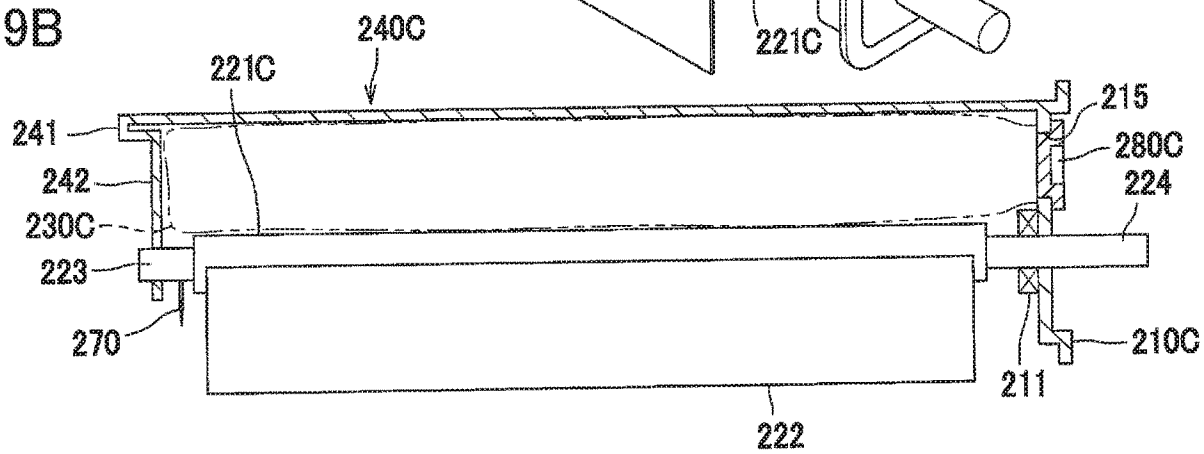
FIG. 9B is a cross-sectional view of the developer accommodating unit of the developing cartridge according to the third embodiment.

As illustrated in FIGS. 8 through 9B, the developing cartridge C includes a casing 100C, and the developer accommodating unit 200C detachably supported to the casing 100C. Specifically, the developer accommodating unit 200C is detachably attached to the developer chamber 110 of the casing 100C through an opening (first opening, not illustrated) of the casing 100C. An agitator 220C of the developer accommodating unit 200C is disposed outside of a developer bag 230C. Similarly to the agitator 220A according to the first embodiment, the agitator 220C is supported such that the first end portion 223 is supported by a rigid frame 240C and the second end portion 224 is supported by a cap 210C. Further, the developer bag 230C is disposed between the agitator 220C and the rigid frame 240C.

The developer bag 230C is bonded to an inner surface of the rigid frame 240C and an inner surface of the cap 210C. The cap 210C is formed with a toner inlet port 215. The toner inlet port 215 is in communication with the interior of the developer bag 230C. Through the toner inlet port 215, the toner T can be supplied to the developer bag 230C from the outside of the casing 100C. The toner inlet port 215 is closed by a stopper 280C. The toner inlet port 215 is an example of a second opening.

As the opening mechanism according to the third embodiment, a cutter 270 is provided at the developer accommodating unit 200C as illustrated in FIGS. 8 through 9B. The cutter 270 is provided so as to protrude radially outward from an outer peripheral surface of the first end portion 223 of an agitator shaft 221C. The cutter 270 rotates together with the agitator 220C. Accordingly, when the agitator 220C rotates, the cutter 270 cuts a lower portion of the developer bag 230C in which the toner T is accommodated.

According to the third embodiment, the following operational advantages can be obtained:

Similarly to the first embodiment, in the developing cartridge C, the cap 210C, the agitator 220C, the developer bag 230C, and the rigid frame 240C are assembled to constitute a sub-unit (developer accommodating unit 200C). The sub-unit is detachably supported to the casing 100C. That is, the sub-unit is detachably attached to the developer chamber 110 of the casing 100C through the opening (first opening) of the casing 100C. Hence, refilling of the toner T that requires exchange of the developer bag 230C can be easily performed.

Further, the toner T can be stored in the casing 100C while hermetically sealed therein. Therefore, this configuration is advantageous for storing the toner T for a long period of time after production and shipment of the developing cartridge C. Thus, outer packaging of the developing cartridge C can be simplified, thereby reducing production cost of the developing cartridge C.

The toner T can be supplied to the developer bag 230C through the toner inlet port 215 formed in the cap 210C. As illustrated in FIG. 8, the toner inlet port 215 having a wide opening enables a greater amount of the toner T to be efficiently accommodated in the developer bag 230C after the flexible developer bag 230C is made compact and inserted into the opening (first opening) of the casing 100C to be attached to the casing 100C.

Further, similarly to the first embodiment, the developer accommodating unit 200C is provided with the rigid frame 240C. In comparison with a case where no rigid frame is provided for connecting respective bearing portions supporting the first and second end portions 223, 224 of the agitator shaft 221C, the developer accommodating unit 200C can be easily handled when the developer accommodating unit 200C is detached from and attached to the casing 100C. Further, the agitator 220C can be securely supported by the rigid frame 240C. Thus, stable driving of the agitator 220C can be realized.

Further, the bearing portions supporting the first and second end portions 223, 224 of the agitator shaft 221C are not provided at the casing 100A, but are provided at the cap 210C and the rigid frame 240C of the developer accommodating unit 200C which is replaceable. The bearing portions are subjected to frictional wearing and thus degrade quickly. Since the bearing portions are provided at the replaceable developer accommodating unit 200C, maintenance and replacement operations of the bearing portions can be easily performed. Thus, service life of the developing cartridge C can be prolonged.

Further, similarly to the first embodiment, the developer bag 230C can be opened in conjunction with driving of the agitator 220C. Hence, when the agitator 220C performs an initial operation after the developing cartridge C is mounted to the image forming apparatus, the developer bag 230C can be automatically opened by using the driving force for rotating the agitator 220C. Thus, no additional driving force is necessary for opening the developer bag 230C. Accordingly, automated opening of the developer bag 230C can be achieved through a simple configuration.

As the opening mechanism, the cutter 270 fixed to the agitator 220C is used. However, similarly to the first embodiment, the discharge opening OP may be formed in the developer bag 230C and sealed with a peel seal from the outside of the developer bag 230C. In this case, the peel seal may be peeled off in conjunction with the driving of the agitator 220C. The opening mechanism according to the third embodiment does not use a peel seal, and therefore, a simple configuration in which the developer bag 230C does not have an opening (discharge opening) can be provided. Further, a sealing member can also be dispensed with.

<Fourth Embodiment>

Next, the developing cartridge D according to the fourth embodiment will be described in detail while referring to FIG. 10.

Figure 10:
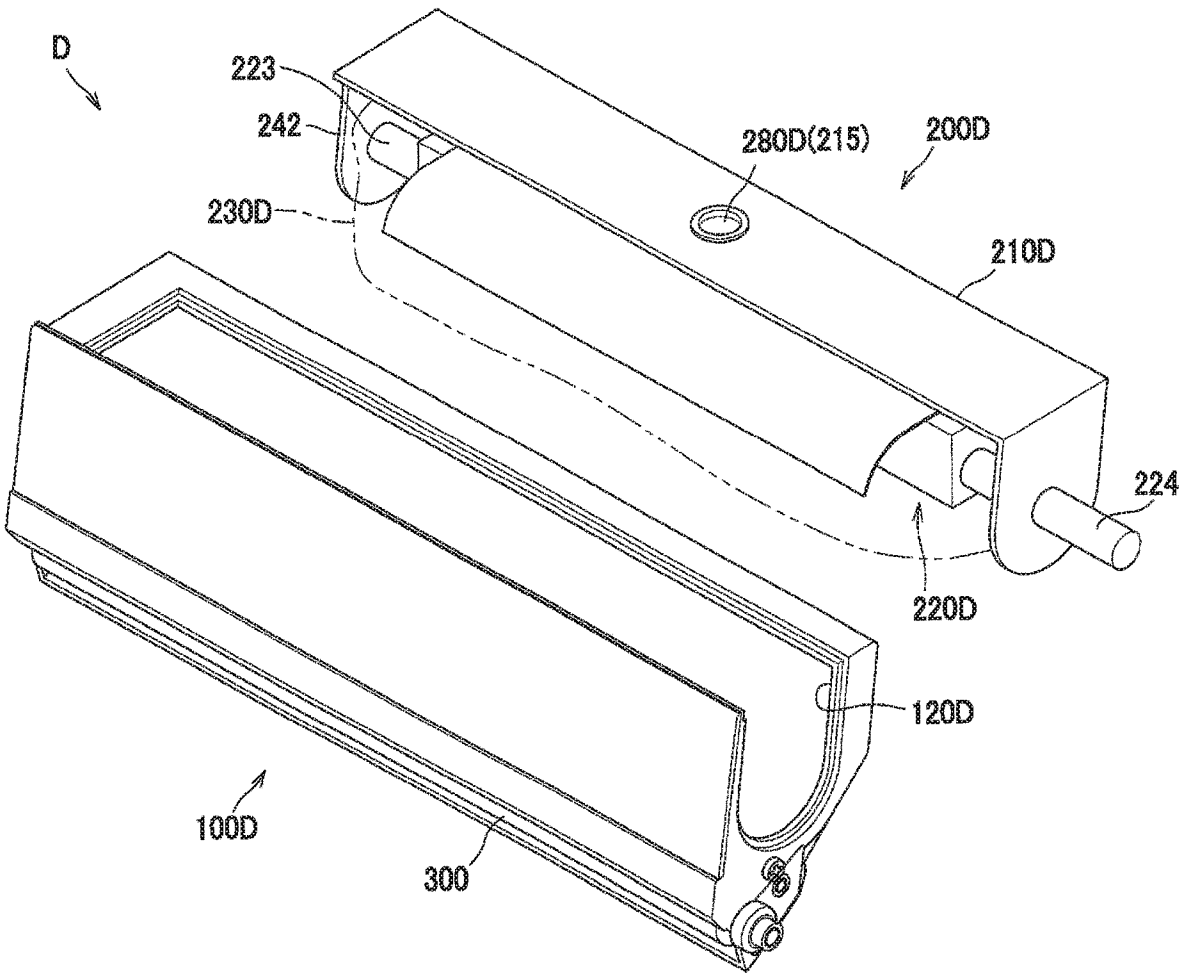
FIG. 10 is an exploded perspective view of a developing cartridge according to a fourth embodiment, in which a developer accommodating unit has not yet been mounted to a casing.

As illustrated in FIG. 10, the developing cartridge D includes a casing 100D, and the developer accommodating unit 200D detachably supported to the casing 100D. Specifically, the developer accommodating unit 200D is detachably attached to the developer chamber 110 of the casing 100D through an opening 120D (first opening). The developer accommodating unit 200D includes a cap 210D having an L-shape in cross-section. The cap 210D is configured so as to close the opening 120D (first opening) of the casing 100D.

In the developer accommodating unit 200D, the first end portion 223 of an agitator 220D is supported by the bearing plate 242 serving also as a rigid frame and the second end portion 224 of the agitator 220D is supported by the cap 210D, similarly to the first embodiment. Further, a developer bag 230D of the developer accommodating unit 200D accommodates the agitator 220D therein, which is also similar to the first embodiment. Further, the developer bag 230D is bonded to an inner surface of the bearing plate 242 and an inner surface of the cap 210D. It should be noted that the toner inlet port 215 that is sealed with a stopper 280D is formed at a top portion of the cap 210D. The toner inlet port 215 has a wide opening, and allows the toner T to be supplied efficiently to the developer bag 230D through the wide opening. The toner inlet port 215 is an example of a second opening.

The developing cartridge D according to the fourth embodiment can also obtain the same operational advantages described in the first embodiment.

Further, according to the fourth embodiment, the opening 120D (first opening) is widely opened. The opening 120D permits the developer accommodating unit 200D to be detached from and attached to the casing 100D in an upward direction or in a diagonally upward direction (i.e. a direction crossing an axial direction of the agitator 220D). Thus, detachment and attachment operations of the developer accommodating unit 200D relative to the casing 100D can be easily performed.

Various modifications to the first through fourth embodiments are conceivable.

According to the above-described embodiments, the flexible developer bag (compressible developer bag) is exemplified as the developer container that is disposed inside the casing and that air-tightly accommodates toner therein. However, the developer container may be a container without flexibility, resiliency, or elasticity as far as the developer container is a hermetically-sealable container. In this case, the developer container may have rigidity equivalent to that of the casing, for example.

According to the above-described embodiments, the developer accommodating unit provided with the developer bag has the toner inlet port. Further, the toner inlet port allows the toner to be supplied to the developer bag in a state where the developer accommodating unit is attached to the casing. However, the opening (first opening) formed in the casing may be made greater, and the developer bag in which the toner has been accommodated may be inserted into the casing through the opening together with the agitator to be accommodated in the casing.

This configuration eliminates the necessity of a toner inlet port and a stopper therefor, thereby simplifying the configuration of the developing cartridge. Further, toner can be accommodated in the developer bag before the developer accommodating unit is attached to the casing, thereby efficiently filling the developer bag with toner.

According to the above-described embodiments, a configuration in which the sealing member for sealing the discharge opening is peeled off by the agitator and a configuration in which the developer bag is torn (open) by the cutter or the protrusion are exemplified as the opening mechanism. However, different configurations may be used as the opening mechanism. Further, the layouts and shapes of the discharge opening, the sealing member, the cutter, and the protrusion are not limited to those described in the above embodiments. The discharge opening, the sealing member, the cutter, and the protrusion may be dispensed with.

For example, instead of forming the discharge opening in the developer container, the developer container in the first embodiment may be modified to have an easily-openable portion along an outer profile of a region corresponding to the discharge opening. The easily-openable portion has strength lower than that of the remaining portions in the developer container so that the developer container can be open therefrom. In this case, the agitator may be connected to a region (connection portion) enclosed by the easily-openable portion, and may pull the easily-openable portion to tear and open the developer container. This configuration eliminates the necessity of the sealing member, the cutter, and the protrusion, and therefore, the number of parts and components can be reduced, thereby reducing the production cost.

According to the above-described embodiments, a configuration in which one end portion of the agitator is supported by the cap is exemplified. However, both end portions of the agitator may be supported by the rigid frame. In this case, the cap may be provided by a flexible member or a resilient or elastic member, similarly to the conventional toner inlet port.

According to the above-described embodiments and modifications thereof, the developing cartridge including the developing roller and the supply roller is exemplified as the developer cartridge. However, the above disclosure may also be available for a developer cartridge detachable from and attachable to a developing device or a process cartridge including a photosensitive drum.

While the description has been made in detail with reference to the embodiments thereof, it would be apparent to those skilled in the art that many modifications and variations may be made therein without departing from the spirit of the disclosure.

What is claimed is:

1. A developer cartridge comprising:

a casing having a first opening and a developer chamber; and a sub-unit detachably attached to the developer chamber through the first opening, the sub-unit comprising:

a cap sealing the first opening;

a developer container disposed in the developer chamber and hermetically accommodating developer therein; and an agitation member disposed in the developer chamber, the agitation member having a first end portion and a second end portion, the agitation member being rotatable relative to the casing about an axis, the axis extending between the first end portion and the second end portion in an axial direction, at least one of the first end portion and the second end portion of the agitation member being supported by the cap and penetrating a thickness of the cap.

2. The developer cartridge according to claim 1, wherein the developer container comprises a deformable bag, the bag hermetically accommodating the developer therein.

3. The developer cartridge according to claim 1, wherein the developer container is bonded to the cap.

4. The developer cartridge according to claim 1, wherein the developer container is bonded to the agitation member.

5. The developer cartridge according to claim 2, wherein the sub-unit further comprises a rigid frame fixed to the cap, the rigid frame being detachably supported in the casing, and wherein the developer container is bonded to the rigid frame.

6. The developer cartridge according to claim 5, wherein at least one of the first end portion and the second end portion of the agitation member is supported by the rigid frame.

7. The developer cartridge according to claim 1, wherein at least a part of the agitation member is disposed inside the developer container.

8. The developer cartridge according to claim 1, wherein the agitation member is disposed outside the developer container.

9. The developer cartridge according to claim 1, wherein the first opening has a shape and a dimension that permit the developer container and the agitation member to pass through the first opening in a state where the developer is accommodated in the developer container.

10. The developer cartridge according to claim 1, wherein the first opening has a shape and a dimension that prohibit the developer container and the agitation member from passing through the first opening in a state where the developer is accommodated in the developer container, and wherein the developer container and the agitation member are configured to pass through the first opening in at least one of a state where the developer container is empty and a state where the developer has been discharged from the developer container into the developer chamber.

11. The developer cartridge according to claim 1, wherein the sub-unit is configured to be detached from and attached to the developer chamber in the axial direction of the agitation member.

12. The developer cartridge according to claim 1, wherein the sub-unit is configured to be detached from and attached to the developer chamber in a direction crossing the axial direction of the agitation member.

13. The developer cartridge according to claim 3, wherein the cap has a second opening for filling the developer container with the developer, the second opening being hermetically sealed.

14. The developer cartridge according to claim 1, further comprising an opening mechanism configured to open the developer container in conjunction with rotation of the agitation member.

15. The developer cartridge according to claim 14, wherein the developer container has a discharge opening for discharging the developer, and wherein the opening mechanism includes a sealing member sealing the discharge opening, the sealing member being connected to the agitation member and configured to open the discharge opening in conjunction with rotation of the agitation member.

16. The developer cartridge according to claim 14, wherein the opening mechanism includes a cutter provided at the agitation member, the cutter being configured to cut the developer container in conjunction with rotation of the agitation member.

17. The developer cartridge according to claim 14, wherein the opening mechanism includes a protrusion fixed to the cap, the protrusion being configured to pierce the developer container in conjunction with rotation of the agitation member.

18. The developer cartridge according to claim 14, wherein the developer container has a portion more easily openable than a remaining portion of the developer container, and wherein the opening mechanism includes a connection portion connecting the agitation member to the developer container, the more easily openable portion of the developer container being open in conjunction with rotation of the agitation member.

19. The developer cartridge according to claim 1, wherein the sub-unit includes a developer inlet port for filling the developer container with developer, the developer inlet port being positioned outside the cap in the axial direction of the agitation member.

20. A developer accommodating unit used for a developing cartridge including a casing, the casing supporting a developing roller and detachably supporting the developer accommodating unit, the developer accommodating unit comprising:

a developer container hermetically accommodating developer therein;

an agitation member configured to agitate the developer within the casing, the agitation member having a first end portion and a second end portion; and a cap sealing an opening formed in the casing in a state where the developer container and the agitation member are disposed inside the casing and a state where the agitation member is rotatably supported to the casing, wherein at least one of the first end portion and the second end portion of the agitation member is supported by the cap and penetrates the thickness of the cap.

* * * * *